US005615567A

United States Patent [19]

Kemp

[11] Patent Number: 5,615,567

[45] Date of Patent: Apr. 1, 1997

[54] EXTERIOR DOOR LOCK COVER

[76] Inventor: Alan D. Kemp, 4203 Cedar Crest La., High Point, N.C. 27265

[21] Appl. No.: 520,993

[22] Filed: Aug. 30, 1995

[51] Int. Cl.[6] ..... E05B 17/18

[52] U.S. Cl. ..... 70/455; 70/55; 70/423

[58] Field of Search ..... 70/51–56, 455, 70/423, 416, 424; 292/347, DIG. 2

[56] References Cited

U.S. PATENT DOCUMENTS

| | | | |
|---|---|---|---|
| D. 192,150 | 1/1962 | Amdur et al. | D8/322 |
| 2,247,592 | 7/1941 | Swift | 70/455 |
| 2,564,012 | 8/1951 | Jordan | 70/455 |
| 2,617,290 | 11/1952 | Schwartz | 70/455 X |
| 2,658,376 | 11/1953 | Shank | 70/455 |
| 2,904,985 | 9/1959 | Murphy | 70/455 X |
| 3,174,788 | 3/1965 | Williams | 292/347 |
| 3,199,121 | 8/1965 | Greto . | |
| 3,434,318 | 3/1969 | Thiry | 70/455 |
| 3,583,185 | 6/1971 | Jacobi | 70/455 |
| 3,740,981 | 6/1973 | Patriquin | 70/455 |
| 4,023,388 | 5/1977 | Morvai | 70/455 |
| 4,082,351 | 4/1978 | Chrones | 70/165 X |
| 4,154,072 | 5/1979 | Flaschar | 70/455 |
| 4,317,344 | 3/1982 | Barnard | 70/55 |
| 4,790,163 | 12/1988 | Appelbaum | 70/455 |
| 4,869,305 | 9/1989 | Jones | 292/DIG. 2 |
| 5,003,795 | 4/1991 | Hoke | 70/455 X |
| 5,046,339 | 9/1991 | Krell | 70/55 |

FOREIGN PATENT DOCUMENTS

| | | | |
|---|---|---|---|
| 2194582 | 3/1988 | United Kingdom | 70/455 |

*Primary Examiner*—Suzanne L. Dino
*Attorney, Agent, or Firm*—Michael I. Kroll

[57] ABSTRACT

An exterior door lock cover (22) comprising a flexible sleeve (24) which fits over an exterior exposed lock member (10) having a keyhole (12) on an exterior door (16). The flexible sleeve (24) will stop any contaminants (20) from entering the keyhole (12) in the lock member (10) which can accumulate and clog the lock member (10) and prevent the proper insertion of a key (26) into the keyhole (12) for operating the lock member (10).

8 Claims, 2 Drawing Sheets

EXTERIOR DOOR LOCK COVER

BACKGROUND OF THE INVENTION

1. Field of the Invention

The instant invention relates generally to protective covering devices and more specifically it relates to an exterior door lock cover.

2. Description of the Prior Art

Numerous protective covering devices have been provided in prior art. For example, U.S. Pat. No. Des. 192,150 to Amdur et al.; U.S. Pat. No. 3,174,788 to Williams; U.S. Pat. No. 3,199,121 to Greto and U.S. Pat. No. 4,869,305 to Jones all are illustrative of such prior art. While these units may be suitable for the particular purpose to which they address, they would not be as suitable for the purposes of the present invention as heretofore described.

AMDUR, CHARLES J.

WEINSTEIN, EDWARD J.

FLEXIBLE DOOR KNOB COVER

U.S. Pat. No. Des. 192,150

Figure 1:
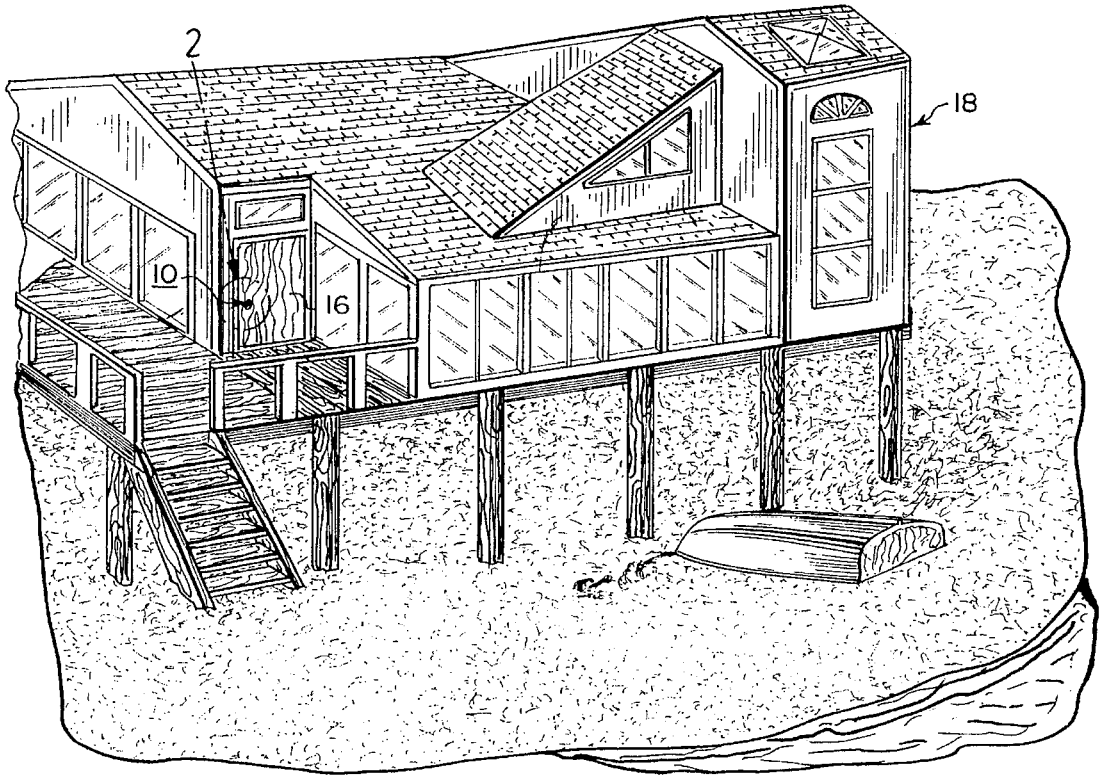
Fig. 1 (PRIOR ART)
FIG. 1 is a front elevation of a flexible door knob cover showing the new design.

The broken line portion is shown fore illustrative purposes only.

WILLIAMS, MARK H.

DOOR KNOB COVER

U.S. Pat. No. 3,174,788

A safety door knob cover comprising in combination a pair of hollow, substantially semi-cylindrical elements. Each of the elements being semi-spheriodal at one end and each having a generally flat opposite end wall of semicircular configuration for loosely enveloping a knob of a door. Hinge means hingeably connecting one cylindrical side of each of the elements together. A latch means on the opposite cylindrical side is for releasably securing the opposite side of the elements together. Each of the flat, semicircular end walls defining a thickened panel to give a degree of rigidity for holding the shape of the cover around a door knob handle. A semicircular opening in each semicircular end wall defining together a circular opening for receiving a shaft of a door knob therethrough. The hollow, semi-cylindrical elements comprising compressible pads defining an enlarged interior housing freely receiving a door knob therewithin. The hinge means comprising a flexible strip carried by one side of the elements yieldably urging the elements towards a closed position about a door knob. The latch means comprising a radially outwardly extending arcuate housing on each element. The housing of each element together containing a latch mechanism for releasably securing the opposite sides of the elements. Each element having a radially outwardly extending stem for releasing the mechanism.

GRETO, JOSEPH

REMOVABLE PROTECTIVE COVER FOR WATER FIXTURES

U.S. Pat. No. 3,199,121

A removable protective cover for enclosing a plurality of water fixtures projecting from a wall over an adjacent bathtub, comprising a closure having connected front, side and top portions and a cushioned exterior. A transverse support is adjustably mounted upon and within the closure. The transverse support has a plurality of slotted openings spaced apart to engage the control stems of the fixtures, thereby supporting the cover in spaced relation over and about the handle portions of the fixtures and further supporting the closure abutting against the wall.

JONES, MARK T.

DOORKNOB ANTI-ROTATION DEVICE

U.S. Pat. No. 4,869,305

A doorknob cover that defeats facile rotation of a doorknob. Two layers of cloth or other low friction material are placed in juxtaposition with one another and joined at their respective outermost peripheral edges. A second attachment is made between the materials just radially inwardly of the outermost peripheral edge to form a toroidal cavity to receive a drawstring. The device is placed over a doorknob and the opposite ends of the drawstrings are tied together tightly, so that the device cannot be removed from the doorknob unless the knot is first untied. Young children are unable to rotate a doorknob covered by the device due to the double layer of cloth and the low frictional engagement between the inner piece of cloth and the doorknob.

SUMMARY OF THE INVENTION

A primary object of the present invention is to provide an exterior door lock cover that will overcome the shortcomings of the prior art devices.

Another object is to provide an exterior door lock cover with a lift tab on its face, to access a keyhole in an exterior doorknob lock or an exterior dead bolt lock, without having to completely remove the cover therefrom.

An additional object is to provide an exterior door lock cover in which the lift tab will automatically go back over the keyhole when the key is withdrawn from the lock, so as to stop the accumulation of contaminants that will build up and clog the lock mechanism within the keyhole.

A further object is to provide an exterior door lock cover that is simple and easy to use.

A still further object is to provide an exterior door lock cover that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a perspective view of a beach front house with the prior art being an exterior door knob with lock installed on the exterior door.

Figure 2:
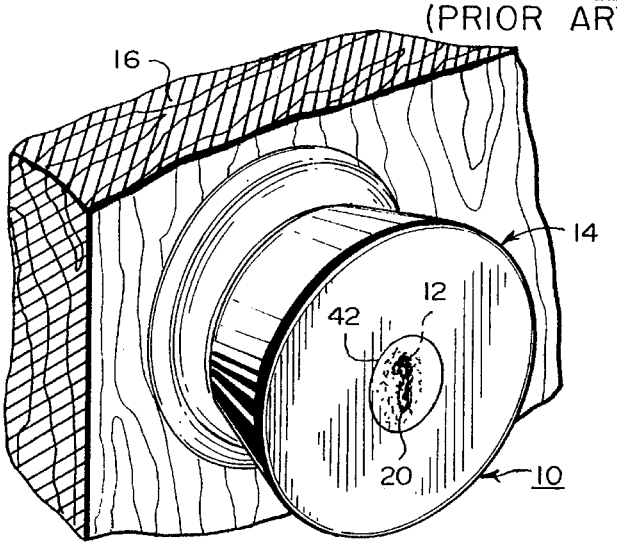
Fig. 2 (PRIOR ART)
FIG. 2 is a side elevation thereof.

FIG. 2 is an enlarged perspective view of the prior art as indicated by arrow 2 in FIG. 1, showing an accumulation of contaminants within the keyhole.

Figure 3:
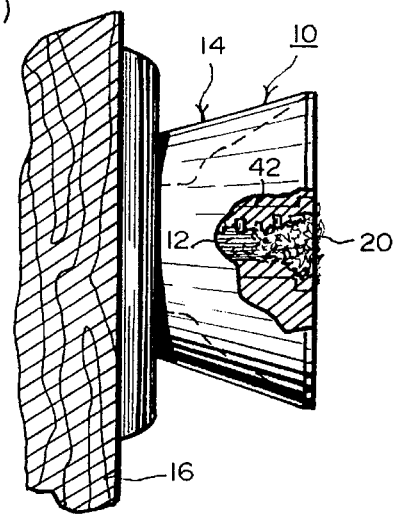
Fig. 3 (PRIOR ART)
FIG. 3 is a rear elevation thereof.

FIG. 3 is a side view taken in the direction of arrow 3 in FIG. 2 with parts of the door knob broken away to see the contaminants within the keyhole.

Figure 4:
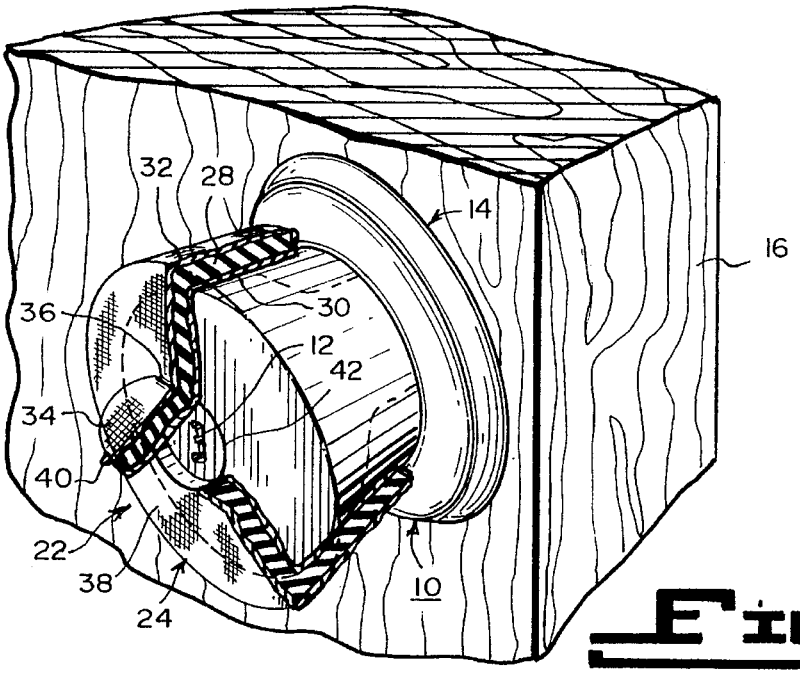
FIG. 4 is a cross sectional view thereof taken through section lines 4—4 in FIG. 1.

FIG. 4 is a perspective view of a first embodiment of the instant invention with parts broken away and in section on an exterior door knob with lock.

Figure 5:
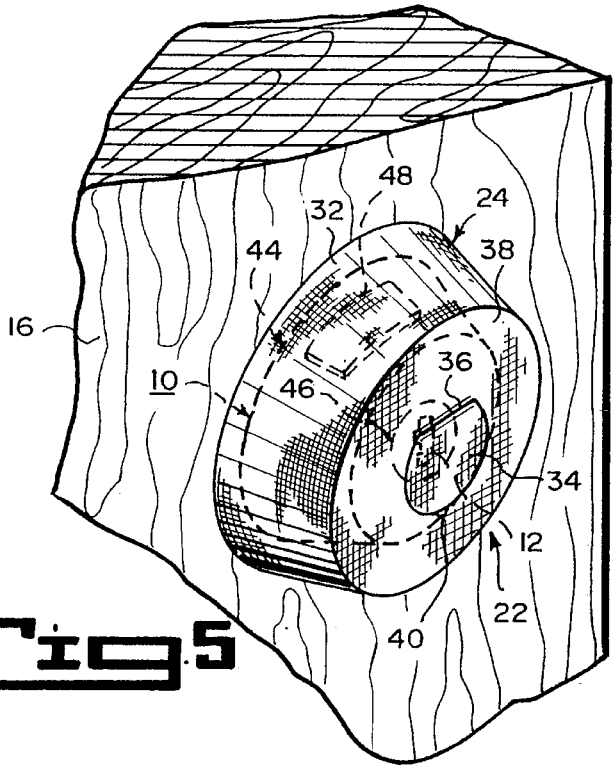

FIG. 5 is a perspective view of a second embodiment of the instant invention on a dead bolt lock.

Figure 6:
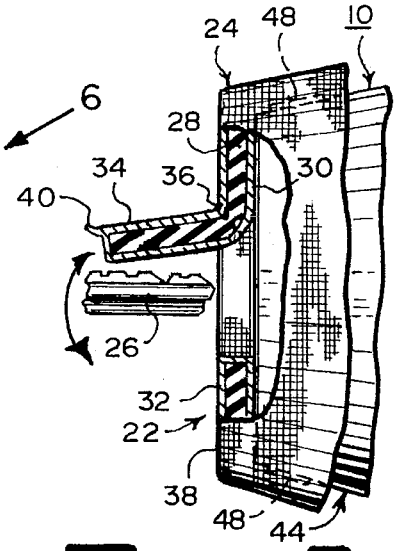

FIG. 6 is a side view taken in the direction of arrow 6 in FIG. 5 with parts broken away and in section showing a key ready to be inserted into the dead bolt lock.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 3 illustrate the prior art being just an exterior exposed lock member 10 with a keyhole 12. The lock member 10 is a doorknob 14 mounted onto an exterior door 16 of a beach front house 18 contaminants 20, such as sand, salt spray, dirt, dust, freezing precipitation and the like is shown built up within the keyhole 12 in FIGS. 2 and 3, thereby making the lock member 10 inoperable.

The instant invention is shown in FIGS. 4 through 6 and consists of an exterior door lock cover 22 comprising a flexible sleeve 24 which fits over the exterior exposed lock member 10 having the keyhole 12 on an exterior door 16. The flexible sleeve 24 will stop any contaminants 20 from entering the keyhole 12 in the lock member 10 which can accumulate and clog the lock member 10 and prevent the proper insertion of a key 26 into the keyhole 12 for operating the lock member 10.

The sleeve 24, as best seen in FIGS. 4 and 6, includes a central layer of closed-cell neoprene 28. A first layer of nylon jersey material 30 is laminated onto an inner surface of the central layer of closed-cell neoprene 28. A second layer of nylon jersey material 32 is laminated onto an outer surface of the central layer of closed-cell neoprene 28, so that the sleeve 24 will have a great elastic four-way stretch.

The sleeve 24 contains a lift flap 34 that is cutout and hinged along a top edge 36 to a front face 38 thereof. When the lift flap 34 is raised it will allow the key 26 easy access to the keyhole 12 in the lock member 10. When the key 26 is removed from the keyhole 12 the lift flap 34 will automatically drop back over the keyhole 12 to cover it. The lift flap 34 also includes a pull tab 40 at a bottom edge, that can be gripped by a person to assist in raising the lift flap 34 up to expose the keyhole 12 in the lock member 10.

The sleeve 24 can be made with glued and taped seams which are flat seams that are waterproof. The neoprene central layer 28 is butted together and glued. The seams of the first layer of nylon jersey material 30 and the seams of the second layer of nylon jersey material 32 are then covered with heat applied tape that seals. The sleeve 24 can be made with glued and blind stitched seams which are seams that are butted together and glued then blind stitched for added strength, making the seams flat and very strong. The sleeve 24 can also be made with flat lock seams which are not glued but are made with a four-needle stitch that is flat and extremely strong.

As shown in FIG. 4, the flexible sleeve 24 is shaped to fit over the exterior exposed lock member 10 in which the lock member 10 is the exterior doorknob 14 with a built-in lock cylinder 42. In FIGS. 5 and 6, the flexible sleeve 24 also can be shaped to fit over the exterior exposed lock member 10, in which the lock member 10 is an exterior dead bolt lock 44 with a built-in lock cylinder 46. The flexible sleeve 24 in FIGS. 5 and 6 includes double sided pressure sensitive tape 48 mounted on an inner surface thereof, so that the sleeve 24 will become better secured to the dead bolt lock 44.

OPERATION OF THE INVENTION

To use the exterior door lock cover 22 as shown in FIG. 4, the following steps should be taken:

1. Place the flexible sleeve 24 over the exterior doorknob 14, so that the lift flap 34 is in front of the keyhole 12.
2. Raise up the lift flap 34 by gripping the pull tab 40.
3. Insert the key 26 into the clean keyhole 12 to operate the lock cylinder 42.
4. Remove the key 26 from the keyhole 12, so that the lift flap 34 will automatically cover the keyhole 12 again.

To use the exterior door lock cover 22 as shown in FIGS. 5 and 6, the following steps should be taken:

1. Place the flexible sleeve 24 with the double sided pressure sensitive tape 48 over the exterior dead bolt lock 44, so that the lift flap 34 is in front of the keyhole 12.
2. Raise up the lift flap 34 by gripping the pull tab 40.
3. Insert the key 26 into the clean keyhole 12 to operate the lock cylinder 46.
4. Remove the key 26 from the keyhole 12, so that the lift flap will automatically cover the keyhole 12 again.

LIST OF REFERENCE NUMBERS

| | |
|---|---|
| 10 | exterior exposed lock member (prior art) |
| 12 | keyhole in 10 |
| 14 | exterior doorknob for 10 |
| 16 | exterior door |
| 18 | beach front house |
| 20 | contaminants in 12 |
| 22 | exterior door lock cover |
| 24 | flexible sleeve of 22 |
| 26 | key |
| 28 | central layer of closed-cell neoprene of 24 |
| 30 | first layer of nylon jersey material of 24 |
| 32 | second layer of nylon jersey material of 24 |
| 34 | lift flap |
| 36 | hinged top edge |
| 38 | front face of 24 |
| 40 | pull tab on 34 |
| 42 | lock cylinder in 14 |
| 44 | exterior dead bolt lock for 10 |

-continued

| LIST OF REFERENCE NUMBERS | |
|---|---|
| 46 | lock cylinder in 44 |
| 48 | double sided pressure sensitive tape |

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An exterior door lock cover comprising a flexible sleeve which fits over an exterior exposed lock member having a keyhole on an exterior door, whereby said flexible sleeve will stop any contaminants from entering the keyhole in the lock member which can accumulate and clog the lock member and prevent the proper insertion of a key into the keyhole for operating the lock member, wherein said sleeve includes:

a) a central layer of closed-cell neoprene;

b) a first layer of nylon jersey material laminated onto an inner surface of said central layer of closed-cell neoprene; and c) a second layer of nylon jersey material laminated onto an outer surface of said central layer of closed-cell neoprene, so that said sleeve will have a great elastic four-way stretch.

2. An exterior door lock cover as recited in claim 1, wherein said sleeve includes a lift flap that is cutout and hinged along a top edge to a front face thereof, so that when said lift flap is raised it will allow a key easy access to the keyhole in the lock member, whereby when the key is removed from the keyhole said lift flap will automatically drop back over the keyhole to cover it.

3. An exterior door lock cover as recited in claim 1, wherein said sleeve includes glued and taped seams which are flat seams that are waterproof, said neoprene central layer is butted together and glued, while the seams of said first layer of nylon jersey material and the seams of said second layer of nylon jersey material are then covered with heat applied tape that seals.

4. An exterior door lock cover as recited in claim 1, wherein said sleeve includes glued and blind stitched seams which are seams that are butted together and glued then blind stitched for added strength, making the seams flat and very strong.

5. An exterior door lock cover as recited in claim 1, wherein said sleeve includes flat lock seams which are not glued but are made with a four-needle stitch that is flat and extremely strong.

6. An exterior door lock cover as recited in claim 1, wherein said flexible sleeve is shaped to fit over the exterior exposed lock member in which the lock member is an exterior doorknob with a built in lock cylinder.

7. An exterior door lock cover as recited in claim 1, wherein said flexible sleeve is shaped to fit over the exterior exposed lock member, in which the lock member is an exterior dead bolt lock with a built-in lock cylinder.

8. An exterior door lock cover as recited in claim 7, wherein said flexible sleeve includes double sided pressure sensitive tape mounted on an inner surface thereof, so that said sleeve will become better secured to the dead bolt lock.

* * * * *